United States Patent [19]

Nowotarski

[11] Patent Number: 4,823,680

[45] Date of Patent: Apr. 25, 1989

[54] WIDE LAMINAR FLUID DOORS

[75] Inventor: Mark S. Nowotarski, Ossining, N.Y.

[73] Assignee: Union Carbide Corporation, Danbury, Conn.

[21] Appl. No.: 129,748

[22] Filed: Dec. 7, 1987

[51] Int. Cl.[4] ..... F24F 9/00

[52] U.S. Cl. ..... 98/36; 34/242; 250/289; 432/64

[58] Field of Search ..... 34/4, 242; 98/36; 250/289; 432/64

[56] References Cited

U.S. PATENT DOCUMENTS

| | | | |
|---|---|---|---|
| 3,053,967 | 9/1962 | Gorman et al. | 219/74 |
| 3,223,396 | 12/1965 | Thompson | 266/5 |
| 3,332,334 | 7/1967 | Melzer | 98/36 |
| 3,575,398 | 4/1971 | Lincoln | 98/36 X |
| 3,676,673 | 7/1972 | Coleman | 250/49.5 TE |
| 3,807,052 | 4/1974 | Troue | 34/1 |
| 3,859,900 | 1/1975 | Fordsmand | 98/36 |
| 3,936,950 | 2/1976 | Troue | 34/4 |
| 4,023,398 | 5/1977 | French et al. | 98/36 X |
| 4,074,620 | 1/1978 | Jansson | 98/36 |
| 4,135,098 | 1/1979 | Troue | 250/492 R |
| 4,223,450 | 9/1980 | Rothchild | 34/4 X |
| 4,298,341 | 11/1981 | Howack | 432/64 |
| 4,315,456 | 2/1982 | Hayashi et al. | 98/36 |
| 4,448,616 | 5/1984 | Francis, Jr. et al. | 148/16 |
| 4,491,610 | 1/1985 | Mansour | 34/242 X |
| 4,551,091 | 11/1985 | Paterson | 432/23 |
| 4,610,391 | 9/1986 | Nowotarski | 228/219 |
| 4,696,226 | 9/1987 | Witmer | 98/36 |

FOREIGN PATENT DOCUMENTS

| | | |
|---|---|---|
| 52-67333 | 6/1977 | Japan . |
| 54-2243 | 1/1979 | Japan . |

OTHER PUBLICATIONS

Streeter, "Handbook of Fluid Dynamics", McGraw Hill, New York, 1961, Section 10, pp. 1–33 and Section 26, pp. 1–21.

Mark S. Nowotarski, "Atmosphere Control In Continuous Furnaces", Industrial Heating, May 1987, pp. 34–36.

*Primary Examiner*—Harold Joyce

*Attorney, Agent, or Firm*—Shirley L. Church

[57] ABSTRACT

A method and apparatus for reducing the amount of an external fluid which travels through an opening into an enclosed area. Also, a method and apparatus for protecting a surface area or plane from contact with or intermixing with an external fluid. The method, in general, comprises causing a fluid to flow, in laminar form, in proximity to or directly across an opening, a surface or an area plane to be protected. The depth or thickness of the flowing laminar fluid layer at its source of origin is at least about 0.05 times the distance across the opening, surface area or plane to be protected, in the principal direction of flow of the fluid at its source of origin. The width of fluid flow at its source of origin and transverse the direction of fluid flow is at least about as great as the maximum width of the opening, surface or area plane to be protected, transverse the direction of fluid flow. The Force Number of the fluid must range between about 0.05 and about 50; the preferred range for the Force Number is from about 0.1 to about 10.

46 Claims, 3 Drawing Sheets

FIG. 1
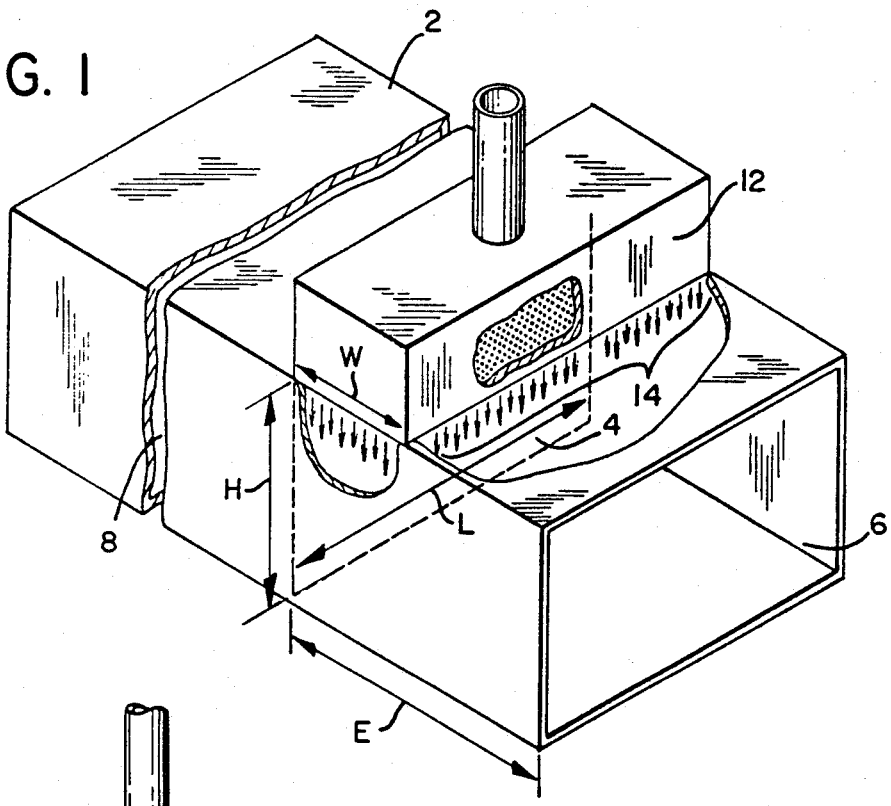
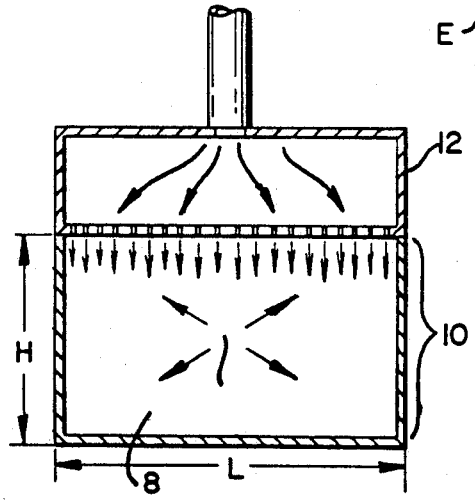
FIG. 1A
FIG. 1B
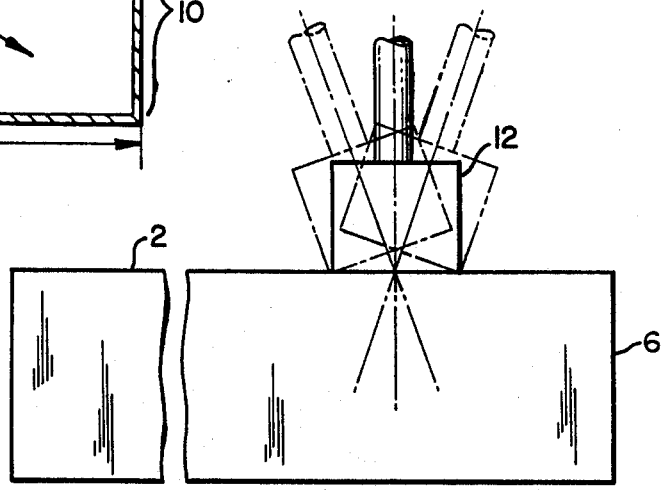

FIG. 2
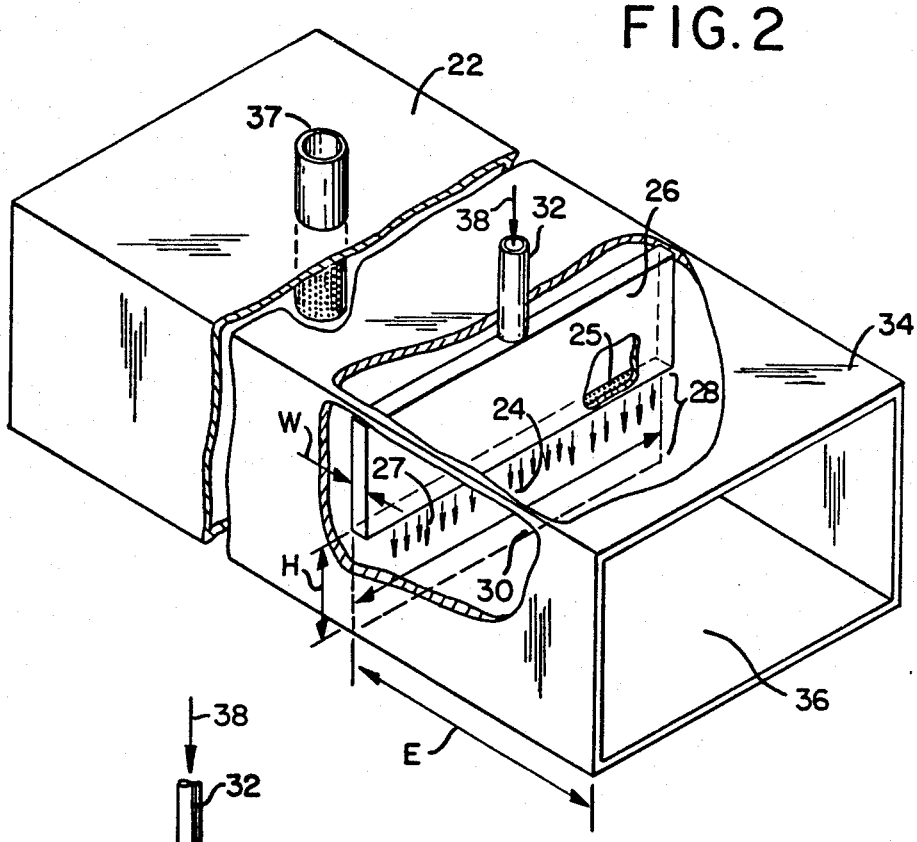
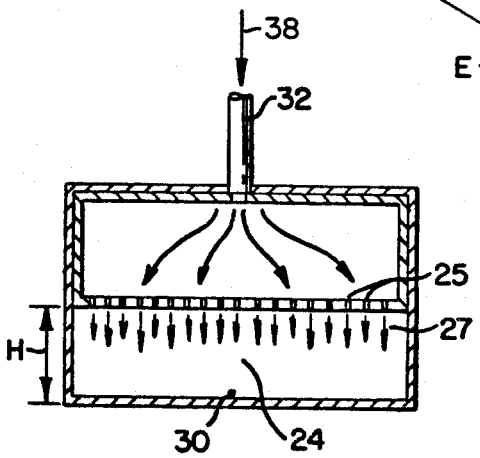
FIG. 2A
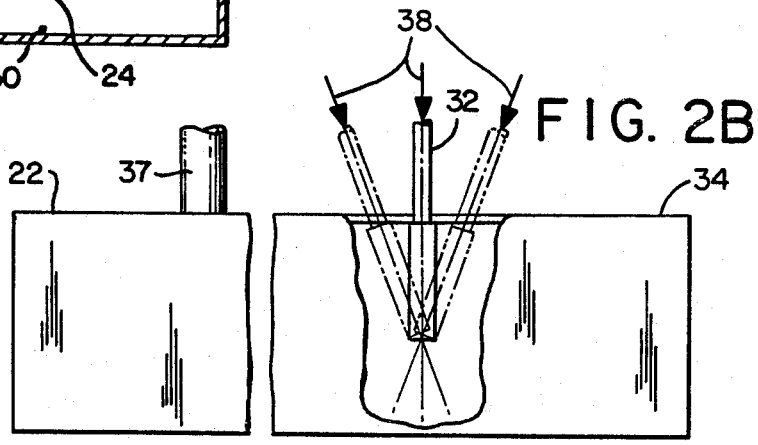
FIG. 2B

WIDE LAMINAR FLUID DOORS

BACKGROUND OF THE INVENTION

1. Field of the Invention

The present invention relates to a method and apparatus for reducing the amount of external fluid which travels through an opening into an enclosed area without impeding movement of a solid object through the opening and without impeding optical access through the opening. The present invention also relates to a method and apparatus for protecting a surface or area plane from contact with or intermixing with an external fluid.

2. Background Art

Use of gas jets and air curtains to direct the flow of gas into a desired space or to control the composition of gas in an enclosed area has enabled the improvement of numerous processes in recent years. Examples of such processes include: Maintaining an inert atmosphere in a chamber in which a cross-linkable polymeric coating is radiation cured; maintaining a non-oxidizing atmosphere above an ultrasonic solder bath; and, reducing heat loss from an industrial oven in which articles are heat treated. Some of the most useful applications of gas jets or curtains are in the prevention of external fluids from entering a process space wherein a continuous conveyor must move parts through the process space. U.S. Patents describing the use of gas jets or curtains in this latter manner include: U.S. Pat. No. 3,676,673, to Coleman, entitled: APPARATUS FOR IRRADIATION IN A CONTROLLED ATMOSPHERE; U.S. Pat. No. 3,807,052 to Troue, entitled: APPARATUS FOR IRRADIATION OF A MOVING PRODUCT IN AN INERT ATMOSPHERE; U.S. Pat. No. 3,936,950, to Troue, entitled: METHOD OF INERTING THE ATMOSPHERE ABOVE A MOVING PRODUCT; U.S. Pat. No. 4,298,341 to Nowacki, entitled: INDUSTRIAL OVEN HAVING MEANS FOR MINIMIZING HEAT LOSS; U.S. Pat. No. 4,448,616, to Francis, Jr. et al., entitled: PROCESS FOR REDUCING BACKMIXING; and U.S. Pat. No. 4,696,226 to Witmer, entitled: FLUID BARRIER CURTAIN SYSTEM.

U.S. Pat. No. 3,807,052 to Troue discloses a treatment enclosure for the continuous in-line irradiation treatment of the surface of a moving coated product. The treatment enclosure includes means for maintaining the surface of a moving coated product under a blanket of inert gas during the irradiation treatment thereof. Troue discusses the importance of the following features regarding inert gas blanketing: That the inert gas flow be laminar; that there be a long entrance tunnel from ambient air which surrounds the enclosure to the source of the inert gas flow and that the gas flow be directed downward toward the surface of the moving coated product.

U.S. Pat. No. 4,448,616 to Francis, Jr., et al. relates to a process for substantially reducing the backmixing or backflow of gases into metal heat treating furnaces by the use of a particular gas jet arrangement and a defined gas flow rate. The gas jet arrangement comprises a pipe with holes which produces a turbulent flow under most conditions of operation. The hole size or width of a slot in the gas distribution conduit is specifically stated not to effect performance of the gas jet in reducing backmixing.

U.S. Pat. No. 4,696,226 to Witmer describes a fluid barrier curtain at an aperture in a wall within a duct, as at the entrance of a furnace. The fluid barrier curtain is used to maintain separation of fluids on opposite sides of the barrier curtain. Witmer discusses the importance of the following features regarding an effective barrier curtain: Having an apparatus which emits a laminar sheet of fluid flow across the aperture zone; the apparatus comprising means for forcing fluid into one side of the aperture zone while removing fluid from the other side of the zone, including the use of thin edge vanes located at the side of the apparatus from which the fluid is removed; and, the relationship between the width of the slot in the fluid curtain emitter and the aperture zone distance across which the fluid enters and exits, e.g. the distance across the aperture zone can be as great as thirty times the width of the slot in the fluid curtain emitter.

Several of the general principals of fluid dynamics which provide background information related to the present invention may be found in Streeter, "Handbook of Fluid Dynamics", McGraw-Hill, New York, 1961 in Section 10, pages 1–33 and in Section 26, pages 1–21.

The design of the apparatus used to prevent an external fluid from entering a process space can vary, as illustrated by the apparatus disclosed in the patents listed above. State of the art technology has permitted the reduction of fluid contaminants within the process space to average concentrations as low as about 100 ppm, with concurrent reductions in total flow of process fluid through openings to the process. The 100 ppm concentration is the normal process condition, with random incursions occurring, during which contaminant concentration can rise as high as ambient concentrations ($10^6$ ppm).

There are some applications for which a 100 ppm contamination level, and particularly random incursions as high as $10^6$ ppm result in product defects or reduced yield. Examples of these applications, not intended to be limiting, follow. Semiconductor manufacturing must be done in a particle-free environment, due to submicron size dimensions in electrical circuitry which can be rendered inoperative by the presence of a particle of dust. Heat-treating, joining and forming of metals requires oxygen-free gaseous environment at elevated temperature, since presence of oxygen (even at concentrations as low as 10 ppm) can cause parts to discolor so that they must be reworked or pickled. In the case of brazing, presence of oxygen may prevent joining from occurring so that the part is ruined. Thick film firing of printed circuits frequently requires several different processing zones in series, with each zone comprising a different atmospheric composition. Molten metal baths such as those used for soldering or galvanizing require protection from oxygen; current technology requires placing an enclosure over the bath and purging it with an inert or reducing gas, or placing an inert liquid atop the molten metal surface. These techniques restrict access to the molten metal surface, cause contamination and substantially increase the operating costs of the process. In addition, there are applications wherein it is desired to protect a window from obscuration by a dirty environment.

The known technology, prior to the present invention, permits incursions of the type previously described due to lack of flow stability. The incursions, due to the resultant high concentration of contaminants, cause substantial damage to the parts or materials being processed, reducing yields and increasing processing costs. Frequently the lack of flow stability is the result of characteristics inherent in the design and operation of the barrier curtain itself.

It is desired to provide a method for reducing fluid and particulate contamination within any given volume of a process space or at the surface of a barrier plane to concentrations at least below 100 ppm while minimizing process fluid flow consumption. In addition, it is desired to provide improved process stability by substantially reducing or eliminating random incursions of contaminants, which in many cases cause more damage to the process or to the surface contacted than the overall average concentration of contaminates. It is also desired to reduce or eliminate the need to use a purge fluid from within the processes space as a method of preventing the entrance of ambient into the process space, since loss or use of purge field from within the process is typically expensive.

SUMMARY OF THE INVENTION

In accordance with the present invention, a method is provided for reducing the amount of an external fluid which travels through an opening into a contained space. Use of the method does not impede movement of a solid object through the opening, nor does use of the method impede optical access through the opening.

The method comprises protecting at least a portion of a contained space from the incursion of external fluids by causing a fluid to flow, in laminar form, in proximity to or directly across at least a portion of at least one opening to the contained space. The depth or thickness of the flowing laminar fluid at its source of origin is at least about 0.05 times the distance across the at least a portion of the at least one opening to be protected, in the direction of fluid flow at the source of origin of the fluid. The width of the fluid flow at its source of origin and transverse the direction of fluid flow is at least about as great as the maximum width of the portion of the opening transverse the direction of fluid flow. In addition, the square root of the ratio of the total momentum force of the fluid layer at its source of origin to the pressure force across the fluid layer, as it flows across the portion of the opening area, ranges from about 0.05 to about 50, with a preferred range of about 0.1 to about 10.

In accordance with some embodiments of the present invention, there is a surface or an area plane which is to be protected from contact by and/or intermixing with an external fluid. The protective fluid is caused to flow in laminar form across the surface or area plane to be protected. The thickness of the protective fluid at its source of origin is at least about 0.05 times the distance across the surface or area plane in the direction of flow at the source of origin of the fluid. The width of the fluid flow at its source of origin and transverse the direction of fluid flow is at least about as great as the maximum width of the surface or area plane transverse the direction of fluid flow. The square root of the ratio of the total momentum force of the fluid layer at its source of origin to the pressure force across the fluid layer, as it flows over the surface or area plane, ranges from about 0.05 to about 50, with a preferred range from about 0.1 to about 10.

Any number of fluid flow layers can be placed about an opening, surface or area plane to be protected, and one fluid layer can be used to protect several openings or area planes. There are some applications wherein it is desired to protect only a portion of an opening or surface; the portion of the opening or surface which must be protected is determined by the requirements of the process. Any arbitrary opening shape can be protected by combining a large number of small-dimensioned fluid layers. The portion of opening, surface or area plane that an individual fluid layer products can overlap with a portion protected by another fluid layer. The fluid layer geometry constraints as well as momentum constraints are considered to be independent of any overlap of protective areas or zones. Different flid compositions can be used for overlapping protective zones which make up a portion of or the entire opening, surface or area plane. Cost, safety, and process compatability will determine which fluids are chosen to provide the fluid door/curtain layer, since fluid composition does not substantially affect fluid performance.

All positive flow rates of a fluid layer which satisfy the constraints of momentum force to pressure force ratio are beneficial in protecting an opening or area plane. Negative flow rates (i.e., exhaust flows) are not effective. Typically, an increased flow rate of the fluid layer provides increased protection from an external fluid entering the protected space; however, increased fluid flow rate is generally more costly so that there is a point of diminishing returns in terms of process economics. There are also some applications for which there is an optimum fluid flow, where an increase in flow initially increases protection and a flow rate is reached after which an increase in flow decreases protection. The optimum flow rate can be determined by minimal experimentation; the fluid at or behind the area plane or opening to be protected is sampled for the intensive property of interest and the fluid flow rate is varied within the limitations previously specified, until the samples indicate the optimum desired material composition is obtained at the sampled location.

As used herein, the "Force Number", Fr, is defined as the square root of the ratio of the momentum force of the fluid layer at its source of origin, Fm, to the pressure force across the layer as it passes over the opening or area plane to be protected, Fp.

$$Fr = \sqrt{\frac{Fm}{Fp}}$$

The momentum force of the fluid layer at its source of origin, Fm, is defined as the reaction force of the fluid against its source of origin. For a fluid, this is equal to:

$$Fm = \rho j \left( \frac{V}{Aj} \right)^2 Aj$$

where $\rho j$ is the fluid density at the fluid source of origin, V is the volume flow rate of the fluid and Aj is the area of the source of origin perpendicular to the direction of fluid flow.

The pressure force, Fp, is defined as the maximum pressure difference across the fluid layer as it passes over the opening, surface, or area plane to be protected times the area of the surface or area plane.

$$Fp = Pmax\ Ah$$

where Pmax is the maximum pressure difference and Ah is the area of the surface or area plane.

If Pmax varies with time, then calculations should be based on the largest expected Pmax. If Ah varies with time, then calculations should be based on the largest expected Ah.

Fm can be controlled in response to Fp so that Fr remains within the desired range. Alternatively, Fm can be controlled in response to process fluid composition measurements at a given sample location so that Fr remains within the desired range.

As used herein, "fluid flow rate" means volumetric flow rate of the fluid at the fluid's source of origin.

As used herein, "laminar" fluid flow means that the root mean square of the random fluctuations in the fluid layer velocity at the source of origin of the fluid layer are less than about 0.1 times the average velocity of the fluid in its direction of flow at its source of origin and that the root mean square of the sizes of turbulent eddies in the fluid layer at its source of origin are less than 0.1 times the thickness of the layer at the source of origin of the fluid layer.

BRIEF DESCRIPTION OF THE DRAWINGS

FIG. 1 illustrates one embodiment of the invention, wherein an opening to an enclosed chamber is protected from the entry of external fluid into the chamber using a layer of fluid flowing from a distribution source positioned above the opening, and wherein the opening size is the same as the cross-sectional area of the enclosed chamber.

FIG. 1A illustrates a break-away cross-sectional view of the portion of FIG. 1 bearing the same numerical and alphabetical identification.

FIG. 1B is a schematically illustrated side elevation of FIG. 1, showing the feature whereby the angle of fluid flow from the fluid distribution source can be adjusted.

FIG. 2 illustrates an embodiment of the invention similar to that illustrated in FIG. 1, but wherein the distribution source of the fluid layer is positioned within or adjacent to the chamber enclosure in a manner which reduces the opening size to the chamber.

FIG. 2A illustrates a break-away cross-sectional view of the portion of FIG. 2 bearing the same numerical and alphabetical identification.

FIG. 2B is a schematically illustrated side elevation of FIG. 2, showing the feature whereby the angle of fluid flow from the fluid distribution source can be adjusted.

DESCRIPTION OF THE PREFERRED EMBODIMENTS

Figure 3:
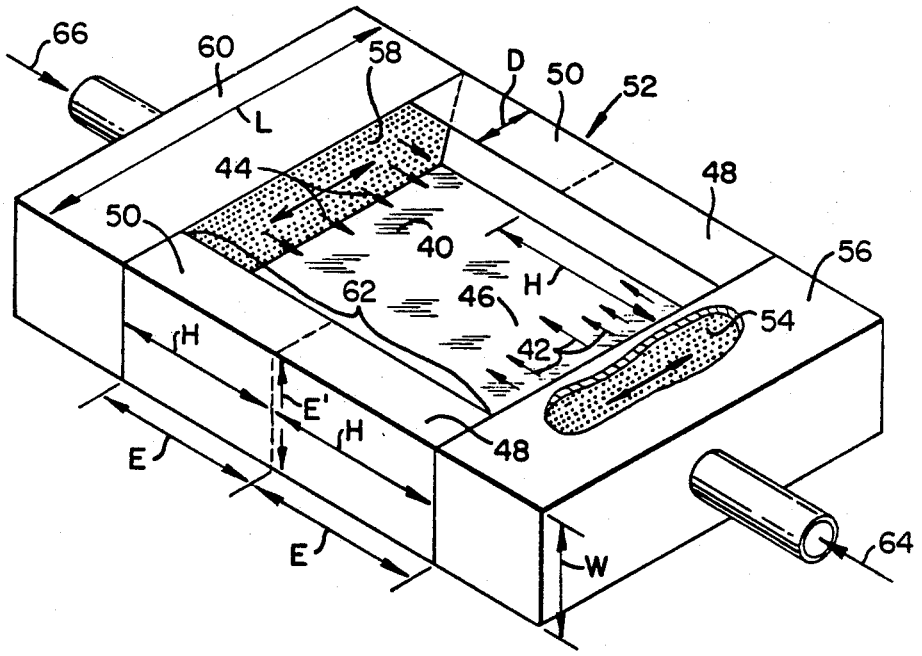
FIG. 3 shows another embodiment of the invention wherein a horizontal surface or plane is protected from contact by surrounding ambient using a layer of fluid from a distribution source positioned to provide fluid flow in a direction parallel to the horizontal surface or plane.

The present invention has broad application in materials processing wherein it is desired to reduce the amount of external fluid, gas or liquid, which travels across boundaries within which the materials processing is taking place. The invention is particularly useful for applications wherein it is desired to move solid material being processed across the same boundaries from which external fluids are to be excluded and for applications where optical access across the same boundaries is desired.

For example, the invention is useful for applications where it is desired to maintain a fluid of a given composition, temperature or other set of intensive properties on one side of an opening (process environment) to an enclosed processing area despite the presence of a fluid of a different composition, temperature or other set of intensive properties on the other side of the opening (ambient).

One embodiment of the present invention is shown in FIGS. 1, 1A and 1B to illustrate the general principles involved. A portion of an enclosed processing chamber 2 is shown having opening 4 which must be protected from entry of ambient fluid 6 present outside processing chamber 2. The processing chamber is filled with environment fluid 8, which differs from ambient fluid 6. The method of the invention is practiced by first defining a barrier plane, a rectangle in this case, 10 (shown at FIG. 1A) having a height H and a length L, across which the ambient fluid 6 is to be prevented from traveling. A fluid distribution source 12 having an opening through which fluid flow 14 occurs, in this case a rectangle of width W and length L, is placed on one side of the barrier rectangle 10. In this case, the fluid distribution source 12 is placed outside processing chamber 2, i.e., on the ambient side of the barrier rectangle 10. A laminar flow of fluid 14 exits the distribution source 12, in this case parallel to the barrier rectangle 10.

The fluid flow 14 can be at an angle toward or away from the processing chamber 2 should the application require, and the desirability of the fluid flow 14 being at such an angle can be determined by sampling at any point within chamber 2 for the desired intensive properties and adjusting the fluid flow 14 direction so as to produce the preferred results.

The width W of the fluid distribution source 12 should be at least about 0.05 times height H of opening 4.

In practice, it is fluid flow 14 which defines the actual barrier 10 which is formed.

The process environment 8, ambient 6 and fluid flow 14 may comprise any fluid composition, temperature, density or other set of intensive properties. Such compositions may comprise, for example, gases, liquids, plasmas, such fluids containing particulate matter, and combinations thereof.

Under some operating conditions, some of fluid flow 14 may mix into process environment 8, so it is preferable that the fluid comprising fluid flow 14 be inert or beneficial with regard to the process being practiced within process environment 8. Under other operating conditions, fluid flow 14 does not mix into process environment 8, so fluid which would be deleterious to the process can be used.

Process requirements, safety considerations, physical limitations, fluid cost, and the judgment of the practitioner of the invention will determine the choice of the fluid comprising fluid flow 14.

The opening 4 can be of any shape, size, or orientation. The layer of fluid flow 14 can also be of varying shape, size or orientation irrespective of the size, shape, or orientation of opening 4. Thus, it is possible to protect only a portion of opening 4 from ambient 6 travel across barrier plane 10.

The layer of fluid flow 14 must exhibit laminar flow characteristics. The performance of the layer of fluid flow 14, under a given set of conditions, can be characterized by the dimensionless Force Number which has been previously defined. In general, the performance of the layer of laminar fluid flow 14 in exclusion of ambient 6 from a given volume of process environment 8 can be optimized within the following Force Number, Fr, range. The required range for the Force Number, Fr, is between about 0.05 and about 50; the preferred Fr ranges between about 0.1 and about 10. The Force Number is proportional to the volumetric flow rate of fluid layer 14. Similar geometries will provide similar performance at the same Force Number. Thus, the performance in a new application can be estimated based on the measured performance in a previous application wherein the geometry of fluid flow 14 and the geometry of plane 10 to be protected is similar.

For applications in which more than one fluid flow component is protecting a given enclosure opening, optimization becomes more complicated, since the fluid flow forces interact and a multivariate optimization must be done. However, an initial estimate of fluid flow requirements can be made using the method of the present invention and the presumption that each component flow must provide the total protection for the portion of the desired barrier plane which it flows across. Subsequently, the amount of fluid flow actually used can be optimized using minimal experimentation, wherein areas of the process environment adjacent to the barrier plane are sampled regarding the intensive properties desired and the fluid flow rate from each individual component making up the barrier plane is reduced or increased until the overall balance desired is obtained.

The design of the fluid flow components will be a function of the degree of protection required, the cost of the environment, the cost of the fluid layer components and the judgment of the practitioner applying the method of the present invention.

The method of the present invention is effectively used when there is a positive flow rate of fluids from within process environment 8 across barrier plane 10, when there is no environment flow exiting across barrier plane 10, or when there is a negative flow rate across barrier plane 10 (i.e., a net inflow of fluid flow layer 14 across barrier plane 10). In the latter case, the fluid layer 14 must be inert or beneficial to the environment 8, and the acceptable amount of net inflow of fluid layer 14 across barrier plane 10 is proportional to the width W of fluid layer 14 and cannot exceed the total flow of fluid flow layer 14.

The method of the present invention is effective even when portions of barrier plane 10 which fluid flow layer 14 is to protect are blocked by physical items. One of the purposes of the method of the present invention is to allow physical objects which are to be processed to enter (and leave) process enclosure 2 without allowing ambient 6 to enter process enclosure 2. There is, however, reduced effectiveness of ambient 6 exclusion if the object prevents fluid flow 14 from reaching a portion of barrier plane 10 which protects a portion of opening 4. This problem can be overcome by using more than one fluid flow component so that the combination of components can reach the area of barrier plane 10 from which a fluid flow layer such as 14 is blocked off. There will be a few physical object configurations for which protection will not be total, for example when the object is a long pipe, the area of barrier plane 10 around the outside of the pipe is protected, but the area of barrier plane 10 corresponding to the inside of the pipe is not protected. Even in such a case, however, the exclusion of ambient 6 from process environment 8 will be greatly improved with the use of at least one laminar fluid flow layer component such as 14.

The action of the fluid flow layer is enhanced if any portion of the walls of process enclosure 2 are extended, at any angle, as solid walls any distance toward ambient 6 from barrier plane 10. FIG. 1 shows all four sides of the enclosure extended a distance E perpendicular from barrier plane 10 into and toward ambient 6. It is preferred to have distance E be greater than or equal to the width W of the fluid flow layer.

EXAMPLE 1

A chamber of the type shown in FIG. 2, 2A and 2B having an opening 24, one one end, was protected from the entry of surrounding ambient 36 as follows. A clear acrylic rectangular box 22, having opening 24 was purged using room temperature helium so that box 22 contained only helium at room temperature. The internal dimensions of box 22 were 5.5 inches high by 8.5 inches wide, by 70 inches long. Because the laminar fluid distribution source 26 was mounted so that it extended downward in front of the entrance to box 22, the size of the opening 24 into box 22 was restricted to about 2.5 inches in height H by about 8.5 inches in length L. Thus, the barrier plane 28 across the opening had a total area of about 21.3 square inches or about 1.48 E-1 square feet. The fluid distribution source 26 had a width W of about 0.5 inches and was positioned so that fluid flow from distributor 26 would be in a direction downward across opening 24. The 0.5 inch width of distributor 26 was about 0.20 times the distance of travel across the opening H. A sample point 30 was located at the bottom of the opening in the center of dimension L, so that it was immediately behind the barrier plane 28 which was on the box 22 side of the laminar fluid distribution source 26.

The laminar fluid distribution sourced device was formed by constructing a box which was solid on all sides except the bottom side 25 from which the fluid 27 was to flow. The bottom side 25 comprised a sheet of sintered metal powder with a porosity of about 2 microns. The fluid 27 used to provide the laminar layer exiting bottom 25 of distributor 26 was room temperature nitrogen. The nitrogen fluid was injected into an opening 32 in the top of the distributor 26. The size scale of any turbulence in the nitrogen fluid 27 flowing from distributor 26 was about equal to the size of porosity (about 2 microns) of bottom 25, much smaller than 0.1 of the 0.5 inch width W of distributor 26. Thus, the fluid flow 27 from bottom 25 of distributor 26 was expected to be laminar in nature. A hot wire anemometer was used to measure the velocity fluctuations as the nitrogen emerged from distributor 26. No velocity fluctuations were observed. Thus, the nitrogen fluid layer 27 exiting distributor 26 was laminar in nature.

An extension 34 was added to the acrylic rectangular box 22 to enhance the effect of the layer of nitrogen fluid in excluding the ambient room temperature air 36 surrounding the box 22. The walls of the extension 34 were 5.5 inches high, 8.5 inches in width (equivalent to length L) and extended out about 2.3 inches past barrier plane 28 of the opening. The distance of the extension out from the barrier plane is shown as "E" in FIG. 2.

When there was no nitrogen fluid layer 27 flowing from distributor 26, a helium purge outward from box 22 of about 3,500 standard cubic feet per hour (SCFH) was required to prevent ambient air (measured as oxygen) infiltration to sample point 30. The helium purge gas was fed into the center of rectangular box 22 through a porous sintered metal cylinder 37 which extended from the top surface of box 22 to the center of box 22. With a nitrogen flow rate of about 375 SCFH from distributor 26, oxygen was excluded to a level of 20 parts per million (ppm) for all helium purge flows—even as low as zero helium purge from the process environment. At some of the lower helium purge flows, some of the nitrogen fluid layer mixed back into box 22, diluting the helium therein. The helium purge from the process environment to be used for a commercial process would be determined by the concentration of nitrogen in the helium environment of box 22 which could be tolerated.

Since helium is much more expensive than nitrogen, a substantial savings can be realized by using a nitrogen wide laminar fluid door to protect a helium environment of a commercial process.

The Force Number for this example can be calculated as follows:

$$Fr = \sqrt{\frac{Fm}{Fp}}$$

wherein the momentum force, Fm, is given by:

$$Fm = \rho j \left( \frac{V}{Aj} \right)^2 Aj$$

where ρj is equal tot he mass density of nitrogen at room temperature and pressure, about 2.25 E-3 slugs/-cubic foot. V is equal to the nitrogen fluid flow rate, about 1.04 E-1 cubic feet per second. Aj is the area of bottom 25 of distributor 26, about 2.95 E-2 square feet. Thus Fm is about 8.28 E-4 lbs.; and, wherein the pressure force, Fp is given by:

$$Fp = Pmax\ Ah$$

where Pmax is the maximum pressure difference across the fluid layer over the area of the opening to be protected; in this case Pmax is equal to the difference in buoyance pressure between helium and air at the top of opening 24 (immediately below the point at which nitrogen flow 27 is exiting from bottom 25 of distributor 26).

$$Pmax = (\rho ag - \rho heg)\ H$$

where ρag is the weight density of air, 7.49 E-2 lb/cubic foot; ρheg is the weight density of helium, 1.04 E-2 lb/cubic foot; and H is the height of opening 24, 2.08 E-1 ft. Thus, Pmax equals 1.35 E-2 lb/ft$^2$. Typically, Pmax will be the difference in pressure across the fluid layer at its source of origin.

Because of the controlled conditions during this experiment, no winds were present (either from within the environment inside enclosed chamber 22, or from ambient 36 surrounding box 22). In a commercial process, winds may be present within the system and such winds may alter Pmax and the point at which Pmax occurs, making it necessary to make pressure measurements at various points across the boundary plane to determine Pmax.

Ah is the area opening 24, 1.48 E-1 square ft.

Thus, Fp equals 1.99 E-3 lb and, the value of the Force Number, fr, is about 0.65.

EXAMPLE 2

A chamber of the type shown in FIG. 2, 2A and 2B having an opening at each opposite end was equipped with a laminar fluid distribution source 26 at each opening. The geometry of each opening and of each distribution source was equivalent to that shown for a single opening in FIG. 2. The internal dimensions of the chamber 22 were about 5.5 inches high, 8.5 inches wide and 48 inches long (between openings). Each distribution source was constructed in the manner and to about the dimensions described in Example 1. Thus, the ratio of width of laminar fluid layer W to the distance of travel of fluid 27 from distribution source 26 to the bottom wall of chamber 22 was about 0.20, satisfying the criteria that such ratio be at least 0.05.

The effectiveness of the laminar fluid layer doors were enhanced by extending the chamber wall out past the openings at each end of the chamber. The length of extension, corresponding to "E" on FIG. 2, past each opening was 12 inches.

A sample point 30 was located at the bottom center of one of the openings.

A purge gas was fed into enclosed chamber 22 at the center of the chamber, through sintered metal cylinder 37, exiting from each opening 24. The purge gas within enclosure 22 was room temperature nitrogen. The laminar fluid 27 used to create the wide laminar fluid door was also room temperature nitrogen. The ambient 36 surrounding chamber 22 was room temperature air.

With the process environment nitrogen purge flow set at 900 standard cubic feet of nitrogen per hour and no flow to the laminar fluid distributors 26, only one of which is shown in FIG. 2, the oxygen level detected at sample point 30 was 1 ppm typically. However, this oxygen concentration was not steady. Occasionally, the oxygen level would rise, to concentrations as high as 1,000 ppm oxygen, and then drop back to its typical concentration over a time period of about one minute. This fluctuation in oxygen concentration was apparently due to random room wind fluctuations which momentarily upset the fluid flow patterns and allowed a small amount of ambient air to travel across opening 24 to sample point 30. Fifteen upsets were observed over a time period of about fourteen minutes, resulting in an upset rate of about 1.07 per minute.

To stabilize the environment within the chamber 22, 150 standard cubic feet per hour of room temperature nitrogen was diverted from the process environment nitrogen purge gas to each laminar flow distributor 26. The total nitrogen flow for the process remained at 900 standard cubic feet per hour, but with 600 SCFH of nitrogen to purge source 37 located in the center of chamber 22 and 150 SCFH to each distributor 26. The oxygen concentration upsets which had occurred at sample point 30 disappeared. The system was monitored for 166 hours and during that time period only 10 upsets were observed, resulting in an upset rate of about 0.001 per minute.

The Force Number for the above system was calculated using the same method as provided in EXAMPLE 1, substituting the appropriate numerical values.

$\rho j = 2.25$ E-3 slugs per cubic foot. The volume flow rate of each laminar fluid layer, V, was 4.17 E-2 cubic ft. per second. The area of each distributor bottom 25 was 2.95 E-2 square feet. Therefore, Fm for each fluid layer distributor was 1.32 E-4 lbs.

The weight density of nitrogen, $\rho N_2$ g, is 7.25 E-2 lb per cubic foot. The weight density of air, pag, is 7.49 E-2 lb per cubic foot. The height of each opening H was 2.08 E-1 feet. Thus, Pmax equal about 5.16 E-4 lb/ft$^2$. The area of each opening was about 1.48 E-1 square feet. Thus, Fp for each wide laminar fluid door was about 7.62 E-5 lb.

Whereby Fr equals about 1.31. This Force Number falls within the preferred range of 0.1 to 10.

As in apparent from the previously presented equations, for a given application having specific equipment and fluid compositions, Fr is controlled by controlling the volume flow rate, V, of the fluid used to provide the fluid layer. The number 38 shown on FIGS. 2, 2A and 2B represents a controlled volumetric flow rate. One skilled in the art will understand that the means of control can be any means known in the art and the specific means is not part of the invention.

EXAMPLE 3

A continuous furnace having two vertical openings, and having an environment of hot nitrogen was protected from contamination by ambient room temperature air surrounding the furnace, using a wide laminar fluid door comprised of air at room temperature.

This example illustrates that the laminar fluid layer can function as an effective door even when flow of the laminar fluid itself into the process environment would be deleterious, since the laminar fluid is air at room temperature and the process environment is hot nitrogen.

A horizontal rectangular furnace 22, one end of which is illustrated in FIG. 2, 2A and 2B with openings 24 at each end was equipped with laminar fluid distributors 26 at the top of each opening. The geometry of each opening and of the distributors was similar to those described in EXAMPLE 2, except that the openings 24 were one inch high H and 24 inches in length L, and the distributors 26 were 0.5 inches wide W and 24 inches in length.

The furnace 22 internal dimensions were 2 inches in height by 24 inches in width (equivalent to L in FIG. 2) by 40 inches long (between openings). The ratio of laminar door width W to the distance of travel from distributor bottom 25 to the bottom wall of furnace 22 was 0.50, satisfying the criteria that such ratio be at least 0.05.

The performance of the wide laminar fluid doors was enhanced by extending the walls of the furnace out from opening 24 so that the E dimension as illustrated in FIG. 2 was about 3 inches at each end of furnace 22.

A sample point (not shown on FIG. 2) was located at the bottom center of one opening 24, about one inch back into the furnace environment from opening 24.

With 600 standard cubic feet per hour (SCFH) of hot (160° C.) nitrogen purge entering through purge source 37 in the center of the furnace, the oxygen concentration at the sample point was about the same as that of air. There were, however, occasional oxygen concentrations as low as about 1000 ppm due to random fluctuations in the nitrogen flow pattern at the opening. Each laminar fluid door distribution 26 was fed with 400 SCFH of room temperature air while the nitrogen purge rate at source 37 was maintained at 600 SCFH. The oxygen level at the sample point decreased to a median concentration of 10 ppm. The decreased concentration of oxygen fluctuated over a range from 1 to 100 ppm due to random fluctuations in the flow pattern at the door. This dramatic decrease in oxygen content at the sample point upon use of laminar fluid doors comprising air was unexpected, in view of the approximately 21% oxygen concentration at the sample point without the laminar fluid doors (even with the nitrogen purge) and in view of air being the laminar fluid 27.

The Force Number for each laminar fluid door can be calculated in a manner similar to the previous examples.

The mass density of the room temperature air used as the laminar door fluid was 2.33 E-3 slugs per cubic foot. The volume flow rate of each laminar fluid layer, V, was 1.111 E-1 cubic feet per second. The area of the bottom 25 of each distributor 26, Aj, was about 8.33 E-2 square feet. Thus, the momentum force, Fm, equaled about 3.45 E-4 lb for each jet.

The weight density of nitrogen at about 160° C., $\rho N_2$ g, is about 5.02 E-2 lb. per cubic foot. The weight density of ambient air, pag, is 7.49 E-2 lb. per cubic foot. Each opening height H was 8.33 E-2 feet. Each opening area was about 1.67 E-1 square feet. Thus, Fp for each opening was about 3.44 E-4 lb.

The Force Number, then, is about 1.0 and within the preferred range of about 0.1 to 10.0.

EXAMPLE 4

A hot solder environment having no purge flow was protected from a room temperature air ambient using room temperature nitrogen laminar fluid doors over the horizontal hot solder surface.

FIG. 3 shows the geometry of the hot solder surface 40 protected by two laminar fluid doors 56 and 34. The two laminar fluid doors, 56 and 60, were placed on opposite sides of solder bath 52 to prevent air above bath 52 from contacting surface 40 of both 52 and oxidizing it. The solder composition was 60 weight percent tin and 40 weight percent lead. The temperature of the solder was 260° C. The total exposed area of surface 40 of solder bath 52 measured about 8.5 inches by about 4.2 inches. The opening 62 to solder surface 40 was a rectangle, measuring about 8.5 inches by about 4.2 inches, a small distance above the solder. The purge flow rate of the solder through opening 38 to the surrounding ambient was zero. The ambient around the solder bath was air. The laminar fluid flow, represented by vectors 42 and 44 comprised room temperature nitrogen.

The distributors 56 and 60 for the laminar fluid were constructed as described in EXAMPLE 1. The 2 micron porous side 54 and 58 of each distributor 56 and 60, respectively, was positioned so that fluid flow vectors 42 and 44 would be parallel to surface 40 of solder bath 52. The room temperature nitrogen fluid represented by vectors 42 and 44 was distributed uniformly by the 2 micron porous sheets 54 and 58 of sintered metal so that laminar layers of room temperature nitrogen flowed across the top of solder surface 40. The laminar layers met at the center of the solder bath opening 62, bending upward therefrom and flowing away from solder bath surface 40. Although a single laminar fluid layer was capable of protecting solder surface 40 from oxidation, it was discovered that the use of two laminar layers as described above provided increased laminar fluid door stability, substantially reducing or eliminating ambient air incursions. The laminar doors were each one inch wide W and 8.5 inches long L. The distance of travel H of each laminar fluid door from each distributor was 2.1 inches so that the entire 4.2 inch dimension of opening 62 was protected. Each door, protected an area 8.5 inches long L by 2.1 inches in length H. Thus, the ratio of laminar flow door width W to distance of travel required for door flow was about 1.0 inch:2.1 inch, or about 0.48, meeting the ratio requirement of at least 0.05.

The effectiveness of the wide laminar flow doors was enhanced using two side shield extensions 48 and 50, one on each side of the bath adjacent to a distributor. The length E of each side shield, was 2.1 inches, equivalent to the distance of travel H for each laminar fluid door. The extensions were further enhanced by bending them at a right angle above bath 52 to form an overhang D above bath 52 which extended a distance of about one inch over bath 52. This formed an enclosure over about one inch of bath opening 62 along each side of bath 52 which did not have a laminar flow distributor (either 56 or 60) positioned along it. The height of the extension E' was about 1.0 inches above bath surface 40.

A sample point 46 was located about 0.125 inches above the top of the solder surface in the center of opening 62.

With no nitrogen flowing from laminar fluid distributors 56 and 60, the oxygen concentration at sample point 46 was about 21% (equivalent to the oxygen concentration in air). When about 200 SCFH of room temperature nitrogen was caused to flow through each distributor 56 and 60, the oxygen concentration at sample point 46 was reduced to about 0.3%. When the nitrogen flow rate was increased to a total of about 400 SCFH from each distributor, the oxygen concentration at sample point 46 was reduced to 2.6 ppm.

The Force Number for each distributor can be approximated in a manner similar to that used in the previous examples.

The mass density of the nitrogen laminar fluid $\rho j$ was 2.25 E-3 slugs per cubic foot. The volume flow rate for each laminar fluid door, V, was 5.56 E-2 cubic feet per second at about 200 SCFH and 1.11 E-1 cubic feet per second at about 400 SCFH. The area of the porous portion 54 and 58 of each distributor 56 and 60, respectively, Aj, was about 5.90 E-2 square feet. Thus, Fm, the momentum force for each laminar flow door was about 1.18 E-4 lb at a nitrogen flow rate of about 200 SCFH and about 4.71 E-4 lb at a nitrogen flow rate of about 400 SCFH.

Typically the pressure force, Fp, is equal to the buoyance force across each laminar flow door. The weight density of nitrogen, $\rho N_2$ g, is about 7.23 E-2 lb per cubic foot. The weight density of air, pag, is about 7.49 E-2 lb per cubic foot. The distance across the laminar flow layer W was about 8.33 E-2 feet. The opening area protected by each laminar flow door, Ah, was about 1.240 E-1 square feet. Thus the pressure force, Fp, across each opening was about 2.56 E-5 lb.

The Force Number, Fr, for each laminar fluid door then, was about 2.14 at a 200 SCFM nitrogen fluid flow rate and about 4.29 at a 400 SCFM nitrogen fluid flow rate. Both of these values fall within the preferred Force Number range of 0.1 to 10.0.

The two laminar fluid layers of the constructed embodiment described above were operated so that the principal direction of fluid flow from each distribution device at its source of origin was located upon the same area plane.

Figure 3A:
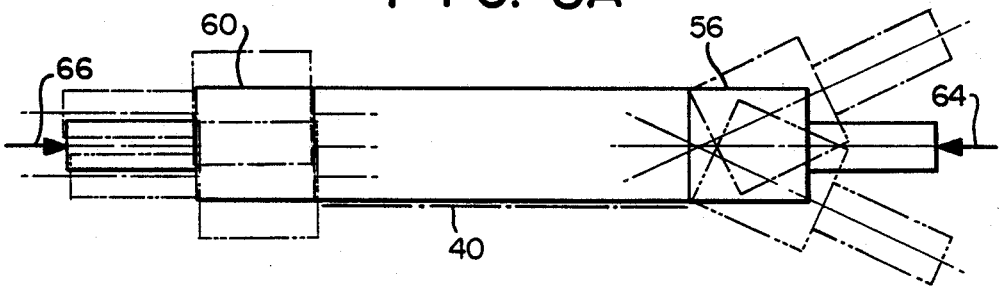
FIG. 3A is a schematically illustrated side elevation of FIG. 3, showing the features whereby the angle of fluid flow from the fluid distribution source can be adjusted and whereby the spacing or distance between the fluid flow layer and the opening or surface to be protected can be adjusted.

However, one skilled in the art will clearly understand that the two laminar fluid flow layer distributors 56 and 60 can be positioned at different spacings above opening or surface 40, such that one fluid flow layer operates over an area plane which is parallel to the area plane of the other fluid flow layer (e.g. one fluid flow layer is positioned above the other fluid flow layer) by adjusting the distance between distributor 56 or 60 and opening or surface 40 as shown in FIG. 3A. In addition, distributors 56 and 60 can be positioned such that the principal direction of flow from one distribution device is parallel to opening or surface 40 while the principal direction of flow from the other distribution device is at an angle to opening or surface 40, by adjusting the angle between distributor 56 or 60 and opening or surface 40 as shown in FIG. 3A, or by a combination of adjusting the distributor spacing above the opening or surface and the angle between the distributor and the opening or surface.

The fluid flow which emanates from each fluid flow layer distributor, 56 or 60, can comprise a different fluid, for example, a controlled volume of a first fluid 64 enters distributor device 56 while a controlled volume of a second fluid 66 enters distributor device 60.

EXAMPLE 5

The hot solder application described in EXAMPLE 4 and shown in FIG. 3 was repeated using argon (a gas heavier than air) as the laminar fluid curtain gas. Conventional wisdom suggests that a very minimal flow of a heavy gas like argon would be required to exclude air from the solder surface. The heavy gas, argon, should settle downward and sit atop the solder surface. Experimentation showed, however, that the argon fluid flow must satisfy the Force Number requirements disclosed herein.

A fluid flow rate of 140 SCFH of argon was required for each laminar fluid door to exclude air down to a concentration of 27 ppm to 77 ppm measured at sample point 46.

The mass density of argon, $\rho j$, is about 3.21 E-3 slubs per cubic foot. The volume flow rate for each laminar flow door was 3.89 E-2 standard cubic feet per second. The area of each fluid door, Aj, was 5.9 E-2 square feet. Thus, Fm, the momentum force for each door was 8.23 E-5 lb.

The weight density of argon, $\rho$arg, is 1.03 E-1 lb per cubic foot. The distance across the laminar flow layer, w, was 8.33 E-2 feet. The opening area protected by each laminar flow door, Ah, was 1.24 E-1 square feet. Thus, the pressure force, Fp, across each opening was about 2.94 E-4 lb.

The Force Number, Fr, for this example of an argon laminar fluid door was about 0.53. This falls within the preferred range for Fr of 0.1 to 10.0.

As is apparent from the previously presented equations, for a given application having specific equipment and fluid compositions, Fr is controlled by controlling the volume flow rate, V, of the fluid used to provide the fluid layer. The numbers 64 and 66 shown on FIG. 3 and 3A represent a controlled volumetric flow rate into fluid distributors 56 and 60, respectively. One skilled in the art will understand that the means of control can be any means known in the art and the specific means is not part of the invention.

Only the preferred embodiments of the invention have been described above, and one skilled in the art will recognize that numerous substitutions, modifications and alterations are permissible without departing from the spirit and scope of the invention, as demonstrated in the following claims.

I claim:

1. A method of protecting at least a portion of a contained space from the incursion of external fluids through at least one opening to said contained space, said method comprising: causing at least one chosen fluid to flow, in laminar form, in proximity to or directly across at least a portion of at least one opening to said contained space, wherein the thickness or depth of said at least one chosen fluid layer at the source of origin of said fluid layer is at least about 0.05 times the distance across said opening in the principal direction of flow of said fluid layer at the source of origin of said fluid layer, wherein the width, transverse the direction of fluid flow of said laminar fluid flow at its source of origin is at least about as great as the maximum width, transverse the direction of fluid flow, of said portion of said opening, and wherein said at least one chosen fluid flow has a Force Number ranging from about 0.05 to about 50.0.

2. The method of claim 1 wherein said at least one chosen fluid flow protects at least about one entire opening.

3. The method of claim 1 wherein said principal direction of fluid flow of said at least one layer at the source of origin of said at least one layer is parallel to at least a portion of an area plane of said at least one opening.

4. The method of claim 1 wherein said principal direction of fluid flow of said at least one layer is at an angle to at least a portion of an area plane of said opening.

5. The method of claim 1 wherein there are more than one laminar fluid flows and wherein the principal directions of flow of said more than one fluid flows at their sources of origin are parallel or on the same area plane.

6. The method of claim 1 wherein there are more than one laminar fluid flows and wherein said principal direction of flow of one of said more than one fluid flows at its source of origin is parallel to one of said at least one openings while the principal direction of flow of another of said more than one fluid flows at its source of origin is at an angle to said one of said at least one openings.

7. The method of claim 1 wherein said Force Number ranges from about 0.1 to about 10.0.

8. The method of claim 1, claim 2, claim 3, claim 4 or claim 5, wherein said at least a portion of any of said at least one opening is protected by more than one chosen fluid flow.

9. The method of claim 1, claim 2, claim 3, claim 4, or claim 5, wherein more than one opening is protected by said at least one fluid layer.

10. The method of claim 1, claim 2, claim 3 or claim 4, wherein more than one opening is protected by a single fluid flow.

11. The method of claim 1, wherein substantially all of said openings to said contained space are protected.

12. The method of claim 1 wherein at least one opening to more than one contained space is protected by a single fluid flow.

13. The method of claim 6 wherein the composition of at least one of said more than one fluid flows is different from the composition of at least one other of said more than one fluid flows.

14. The method of claim 8 wherein the composition of at least one of said more than one chosen fluid flows is different from the composition of at least one other of said more than one chosen fluid flows.

15. The method of claim 1 wherein said chosen fluid is comprised of said external fluid.

16. A method of protecting at least one surface or area plane from contact by or intermixing with an external fluid, said method comprising: causing at least one chosen fluid to flow, in laminar form, in proximity to or directly across at least a portion of said at least one surface or area plane, wherein said at least one chosen fluid flow has a depth or thickness at least about 0.05 times the distance across said at least a portion of said at least one surface or plane in the principal direction of flow of said at least one chosen fluid at its source of origin, wherein the width, transverse the direction of fluid flow, of said at least one laminar fluid flow at its source of origin is at least about as great as the maximum width, transverse the direction of fluid flow, of said at least a portion of said at least one opening, and wherein said at least one chosen fruit flow has a Force Number ranging from about 0.05 to about 50.0.

17. The method of claim 16 wherein said at least one chosen fluid flow protects at least about one entire surface or area plane.

18. The method of claim 16 wherein said principal direction of flow is parallel to any of said at least one surface or area plane.

19. The method of claim 16 wherein said principal direction of flow is at an angle to any of said at least one surface or area plane.

20. The method of claim 16 wherein there are more than one laminar fluid flows and wherein the principal directions of flow of said more than one fluid flows at their sources of origin are parallel or on the same area plane.

21. The method of claim 16, claim 17, claim 18, claim 19, or claim 20 wherein more than one surface or area plane is protected by said at least one fluid layer.

22. The method of claim 16, claim 17, claim 18, or claim 19 wherein more than one surface or area plane is protected by a single fluid flow.

23. The method of claim 16 wherein more than one fluid flows are used and wherein said principal direction of flow of any one of said more than one fluid flows is parallel to at least a portion of at least one surface or area plane to be protected while said principal direction of flow of any other one of said more than one fluid flows is at an angle to another at least a portion of at least one surface or area plane to be protected.

24. The method of claim 16, claim 17, claim 18, claim 19 or claim 20 wherein at least a portion of any of said at least one surface or area plane is protected by more than one chosen fluid flow.

25. The method of claim 24 wherein the composition of at least one of said more than one fluid flows is different from the composition of at least one other of said more than one fluid flows.

26. The method of claim 16 wherein said Force Number ranges from about 0.1 to about 10.0.

27. An installation for protecting at least a portion of a contained space from the incursion of external fluids using at least one fluid flow layer, wherein the fluid flow is in laminar form, wherein the thickness of the at least one fluid layer at its source of origin is at least about 0.05 times the distance across the opening to the contained space which is to be protected by the at least one fluid flow layer, wherein the lengthwise dimension of the at least one fluid layer at its source of origin is at least about equal to lengthwise dimension the width of the opening which the fluid layer is to protect, and wherein the at least one fluid flow has a Force Number ranging from about 0.05 to about 50.0, said installation comprising:

(a) at least one device from which laminar fluid flow emanates, whereby at least one chosen fluid is caused to flow in proximity to or directly across at least at portion of said at least one opening;

(b) means for supplying said chosen fluid to said at least one device;

(c) means for controlling the flow of said chosen fluid from said device so that said fluid flow is laminar;

(d) means for controlling the flow dimensions of said chosen fluid from said at least one device so that the depth or thickness of each fluid flow layer flowing from each of said at least one device is at least about 0.05 times the distance in the principal direction of flow from said each device across said at least a portion of said at least one opening in the principal direction of flow from said each device;

(e) means for controlling the momentum force, Fm, of each said fluid flow layer so that a Force Number, Fr, is generated for said each fluid flow layer which ranges between about 0.05 and 50.0; and, (f) means for mounting said at least one device in proximity to said at least one opening so that a summation of component flows from said at least one device extends in proximity to or directly across at least one area having dimensions as large as said at least a portion of said at least one opening to be protected.

28. The installation of claim 27 wherein said at least one device is mounted so that said principal direction of flow of said at least one chosen fluid is parallel to any of said at least one opening.

29. The installation of claim 27 wherein said at least one device is mounted so that said principal direction of flow of said at least one chosen fluid is at an angle to any of said at least one opening.

30. The installation of claim 27 wherein more than one fluid flow devices are used and wherein at least one of said more than one devices is mounted so that said principal direction of flow is parallel to said at least one opening while the principal direction of flow or another of said more than one devices is at an angle to the same said at least one opening.

31. The installation of claim 27 wherein more than one fluid flow device is used and wherein the principal directions of flow of said more than one fluid flows at their source of origin are parallel or on the same area plane.

32. The installation of claim 27 wherein said means of control in step (e) is capable of controlling Fm so that Fr is maintained at or near a setpoint ranging from about 0.05 to 50.

33. The installation of claim 32 wherein said means of control in step (e) is capable of controlling Fm so that Fr is maintained at or near a setpoint ranging from about 0.1 to 10.

34. The installation of claim 27, claim 32 or claim 33 wherein Fm is controlled in response to measured variations in Fp.

35. The installation of claim 27, claim 32, or claim 33 wherein Fm is controlled in response to a measured contaminant level in said contained space to maintain a contaminant level below a specified concentration while maintaining Fr within said specified range.

36. An installation for protecting at least one surface or area plane from contact by or intermixing with an external fluid using at least one fluid flow layer, wherein the the fluid flow is in laminar form, wherein the thickness of the at least one fluid layer at its source of origin is at least about 0.05 times the distance across the surface or area plane to be protected by the at least one fluid flow layer, wherein the lengthwise dimension of the at least one fluid layer at its source of origin is at least about equal to the lengthwise dimension of the surface or area plane which the fluid layer is to protect, and wherein the at least one fluid flow has a Force Number ranging from about 0.05 to about 50.0, said installation comprising:

(a) at least one device from which laminar fluid flow emanates, in proximity to or directly across said at least a portion of said at least one surface or area plane;

(b) means for supplying a chosen fluid to said at least one device;

(c) means for controlling the flow rate of said chosen fluid from said at least one device so that said fluid flow is laminar;

(d) means for controlling the flow dimensions of said chosen fluid from said at least one device so that the depth or thickness of each fluid flow layer flowing from each said at least one device is about 0.05 times the distance in the principal direction of flow from said each device across said at least a portion of said at least one surface or area plane;

(e) means for controlling the momentum force, Fm, of each said fluid flow layer so that a Force Number, Fr, is generated for said each fluid flow layer which ranges between about 0.05 and 50.0; and, (f) means for mounting said at least one device in proximity to said at least a portion of said at least one surface, or area plane so that a summation of component flows from said at least one device extends in proximity to or directly across at least one area having dimensions at least about as large as said at least a portion of said at least one surface, or area plane to be protected.

37. The installation of claim 36 wherein said at least one device is mounted so that said principal direction of flow from any of said at least one devices is parallel to any of said at least one surface or area plane.

38. The installation of claim 36 wherein said at least one device is mounted so that said principal direction of flow from any of said at least one devices is at an angle to any of said at least one surface or area plane.

39. The installation of claim 36 wherein more than one devices are mounted so that said principal direction of flow from at least one of said more than one devices is parallel to any of said at least one said surface or area plane while said principal direction of flow from any other one of said more than one devices is at an angle to another at least one surface or area plane.

40. The installation of claim 36 wherein more than one fluid flow devices are used and wherein at least one of said more than one devices is mounted so that said principal direction of flow from said at least one device is parallel to said more than one surface or area plane while the principal direction of flow from any other of said more than one devices is at an angle to the same said at least one opening.

41. The installation of claim 36 wherein said means of control in step (e) is capable of controlling Fm so that Fr is maintained at or near a setpoint ranging from about 0.05 to 50.

42. The installation of claim 41 wherein said means of control in step (e) is capable of controlling Fm so that Fr is maintained at or near a setpoint ranging from about 0.1 to 10.0.

43. The installation of claim 36, claim 41 or claim 42 wherein Fm is controlled in response to measured variations in Fp.

44. The installation of claim 36, claim 41 or claim 42 wherein Fm is controlled in response to a contaminant level measured at or near said surface or area plain to be protected so that a contaminant level below a specified concentration is maintained at said measuring location.

45. The installation of claim 27 or claim 36 wherein said at least one device from which laminar fluid emanates or flows comprises a porous wall, and wherein said porous wall exhibits a porosity less than about 0.1 times the depth or thickness of the laminar fluid layer emanating there-from.

46. The installation of claim 45 wherein said porous wall is comprised of a sheet of sintered metal powder.

* * * * *